United States Patent [19]

de Larosiere

[11] Patent Number: 4,634,028

[45] Date of Patent: Jan. 6, 1987

[54] CONTAINER REINFORCEMENT

[76] Inventor: Pierre J. de Larosiere, 30 Duque de Palmela, 4C, 1200 Lisbon, Portugal

[21] Appl. No.: 672,454

[22] Filed: Nov. 16, 1984

[51] Int. Cl.[4] ..... B67D 5/60; B65D 25/02

[52] U.S. Cl. ..... 222/464; 222/143; 222/211; 220/71; 215/1 C

[58] Field of Search ..... 222/211, 464, 143; 220/71; 215/1 C

[56] References Cited

U.S. PATENT DOCUMENTS

| | | | |
|---|---|---|---|
| 2,989,216 | 6/1961 | Moro-Lin | 222/211 |
| 3,223,295 | 12/1965 | Falerni et al. | 222/464 |
| 4,159,790 | 7/1979 | Bailey | 222/211 |

*Primary Examiner*—John E. Kittle
*Assistant Examiner*—James J. Seidleck
*Attorney, Agent, or Firm*—Dennis H. Lambert

[57] ABSTRACT

The object of the invention is to provide an axial reinforcement for containers, such as molded plastic bottles for milk and water and the like, to enable stacking of the containers without requiring expensive secondary packaging.

The reinforcement is an elongate tubular member (1) extending axially within a container (8) and having outwardly flared end portions (2) and (3) which engage the container neck or rim (19) and bottom (7) respectively. The ends are shaped to prevent relative axial and lateral displacement between the member and container, and holes (17,18) are formed through the side of the member to enable product to flow therethrough into the container during filling and to control flow from the container during pouring.

Another object is to control flow from a large container during pouring, wherein the holes (17,18) in the member (1) prevent excessive motion of liquid as the container is tipped for pouring.

10 Claims, 10 Drawing Figures

CONTAINER REINFORCEMENT

TECHNICAL FIELD

This invention relates to reinforcing structures for containers, and particularly, to an elongate member which is inserted inside a container and which engages the top and bottom of the container to provide axial reinforcement to the container.

In the container industry there is an increasing tendency to replace glass and paperboard bottles and other containers with molded synthetic plastic bottles. The molded plastic containers are usually more economical than the glass or paperboard containers, and also have other advantages and characteristics. However, these containers generally do not possess the strength of a glass container. Moreover, there is a continuing trend to further reduce costs of such containers by further reducing the quantity of plastic used in producing them. This is made possible, in part, as a result of improved materials and bottle designs.

There is a limit, however, to the extent of weight reduction which can be achieved in such bottles, especially if the bottle is required to be load bearing. This might be necessary, for example, when packages of bottles are used, such as in the bottled water or milk industry. The same requirements typically also exist for bottled juices, oil, detergents, etc. In such instances, the bottles are boxed or packaged in groups of four, six, twelve, twentyfour or more and palletized for warehousing and distribution.

The producers of such products have to analyse and compare the costs of secondary packaging, i.e., cartons, crates, etc., which will impart the necessary "stacking" capability to such packages while preserving the economies obtained by reducing the bottle weight to a minimum. In most cases of non-carbonated liquids, the weight savings of the bottle itself are often negated by the additional costs of heavier secondary packaging required to impart the stacking capability to the units.

Ideally, the primary packaging, i.e. the bottle itself, should provide all the load bearing requirements of normal use and still weigh little more than the most lightweight bottles now in use.

Moreover, the tendency in the industry to use molded plastic containers has resulted in bottles of a larger capacity. Since the weight of the container itself is insignificant in such a package, the container can accomodate a larger quantity of liquid and remain within the same overall weight. This, however, results in pouring conditions which are more difficult for the consumer to control. The greater mass of liquid within the container moves about freely, resulting in irregular flow patterns as the liquid is poured. This is particularly evident in the one gallon size containers, which may be handled by children, who find it very difficult to pour when the container is full.

BACKGROUND ART

In the prior art, reduction in the amount of material used in the manufacture of molded plastic containers has necessitated the use of stronger secondary packages, such as corrugated cardboard cartons, or returnable plastic, metal or wooden crates or shells.

U.S. Pat. Nos. 3,223,295 and 4,159,790 both disclose containers in which internally extending tubes are provided. However, these are collapsible containers and the tubes are intended to assist in the removal of product from the containers.

DISCLOSURE OF THE INVENTION

In accordance with the present invention, a tubular member is inserted inside the container, extending from the top to the bottom thereof to reinforce the container in the axial direction and at the same time improve control over the pouring of material from the container. The tubular member is inserted through the opening in the bottle and forced downwardly until it comes into contact with the bottom of the container. Interengaging detent means or positioning means are on the bottom end of the member and on the bottom of the container to insure that the member is held in the proper position.

The member has a plurality of holes formed in the side thereof through which product flows during filling and pouring operations. These openings or holes control the flow during pouring and facilitate use of the container, but do not adversely affect the filling operation.

BRIEF DESCRIPTION OF THE DRAWINGS

Details of the invention will be described in connection with the accompanying drawings, in which.

BEST MODE FOR CARRYING OUT THE INVENTION

Figure 1:
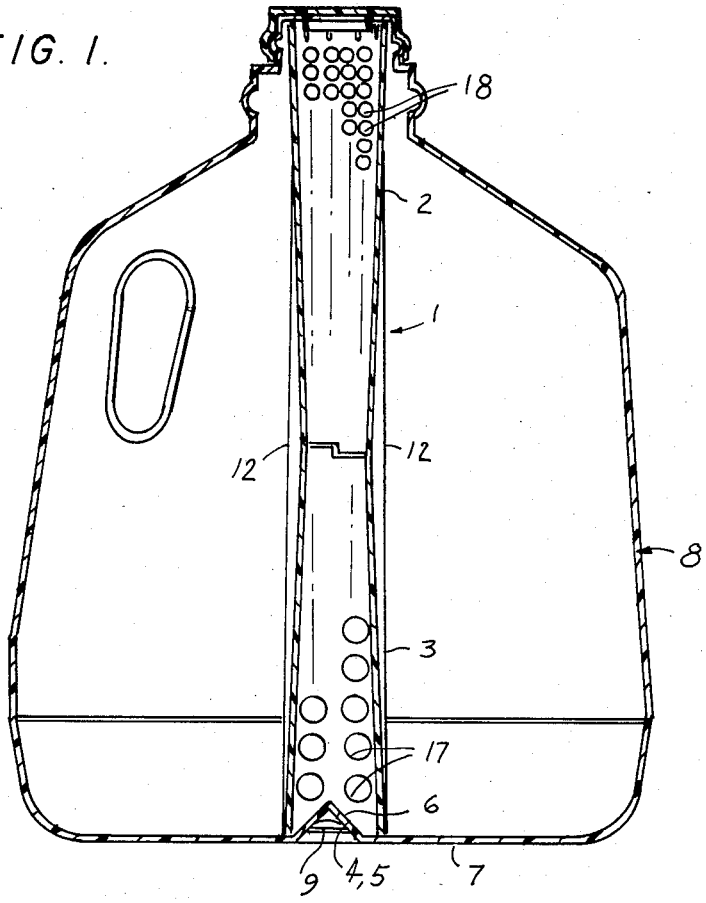
FIG. 1 is an enlarged, vertical sectional view taken through a container incorporating the reinforcing member of the invention therein.
Figure 9:
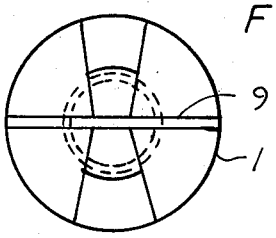
FIG. 9 is a plan view of FIG. 8, looking in the direction of the arrow "9"

The container reinforcement 1 in accordance with the invention comprises an elongate tubular member having oppositely outwardly flared end portions 2 and 3 extending from approximately the midportion of the length of the member.

End portion 3 comprises the lower end of the tubular member and has a pair of diametrically opposed notches or cut-outs 4 and 5 in the end thereof, for straddling or receiving a complementally shaped ridge 6 in the bottom 7 of a container 8. The container, for example, may comprise a one-gallon size, blow-molded plastic bottle for containing milk, water, etc. In addition, to insure positive location and "locking" of the lower end of the tubular member relative to the bottle bottom, a transversely extending web 9 is formed in the lower end of the tubular member for engagement in a complemental notch (not shown) formed in the ridge 6 in the bottom of the bottle. Alternative detent means may be provided between the lower end of the tubular member and the bottle for positively locating the tubular member relative to the bottom of the bottle, if desired. For example, the ridge 6 may simply have shallow transverse grooves or notches therein for receiving the lower end of the tubular member, which, when acting in concert with the cut-outs 4 and 5, prevent any relative lateral movement between the lower end of the tubular member and the bottom of the bottle.

End portion 2 comprises the upper end of the tubular member and has a slightly outwardly flared end 10 with longitudinally extending notches 11 therein to render the end 10 somewhat flexible in a radial direction.

A plurality of longitudinally extending reinforcing ribs 12 (four in number in the specific embodiment shown) are equally spaced about the outer surface of the tubular member and extend from the lower end to a position spaced slightly below the upper end of the tubular member.

Similarly, a plurality of longitudinally extending reinforcing ribs 13 are on the inner surface of the tubular member, extending downwardly from just below the notched end 10 to a position below the upper ends of the ribs 12 on the outer surface of the tubular member.

Figure 5:
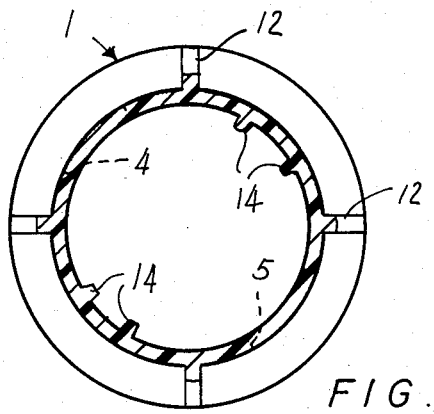
FIG. 5 is a transverse sectional view of the reinforcing member of FIG. 3, taken along line 5—5 in FIG. 3.

Corresponding longitudinally extending reinforcing ribs 14 are formed on the inner surface of approximately the lower third of the bottom end of the tubular member. As seen in FIG. 5, these ribs 14 are spaced relatively closely together in opposite segments in order to accomocate the cut-outs 4 and 5.

At the midportion 15 of the tubular member, where the two oppositely flared ends 2 and 3 meet, an internal, stepped flange 16 is provided for keying engagement with a ram (not shown) used to insert and position the tubular member inside a bottle.

The tubular member has a plurality of holes formed through the side thereof, with larger holes 17 in the lower end and smaller holes 18 in the upper end portion. The larger holes 18 facilitate filling of the bottle, while the smaller holes 17 control flow of liquid from the bottle during pouring.

Figure 10:
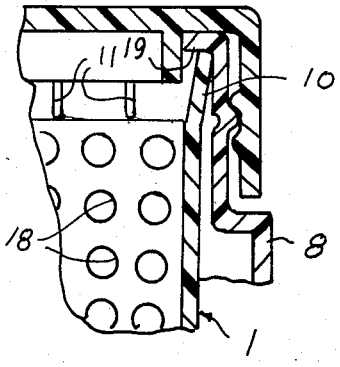
FIG. 10 is an enlarged fragmentary sectional view of the engagement between the upper end of the reinforcing member and the container neck.
Figure 8:
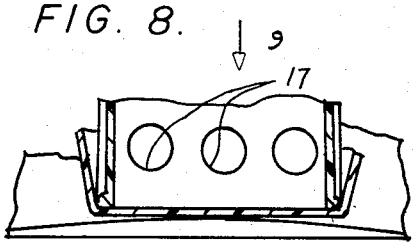
FIG. 8 is an enlarged fragmentary sectional view, showing details of the aligning structure at the bottom of the device.
Figure 2:
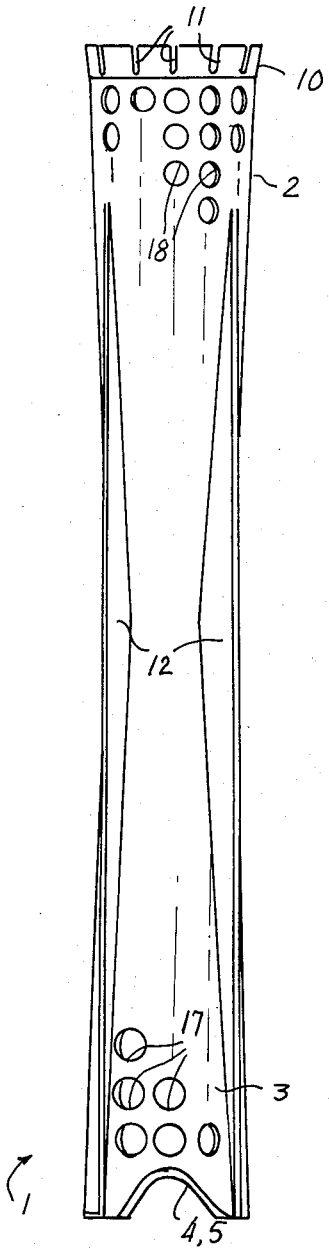
FIG. 2 is a view in side elevation of the reinforcing member of the invention.
Figure 3:
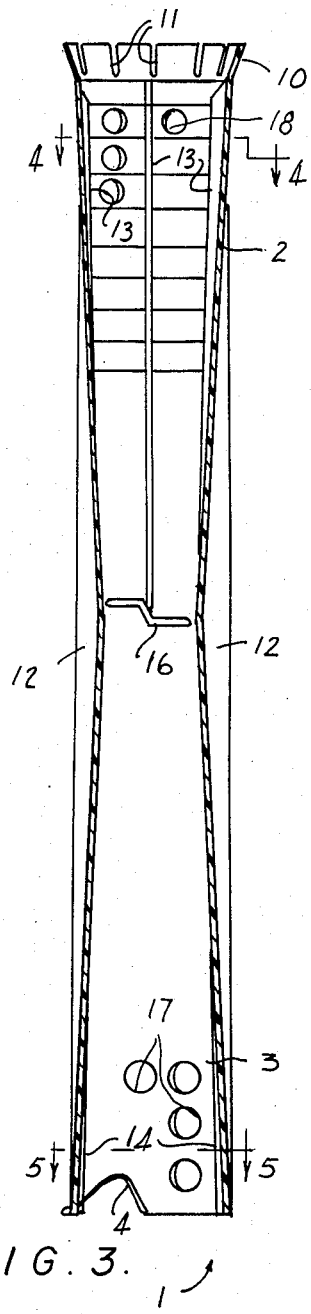
FIG. 3 is a vertical sectional view of the reinforcing member of FIG. 2.
Figure 7:
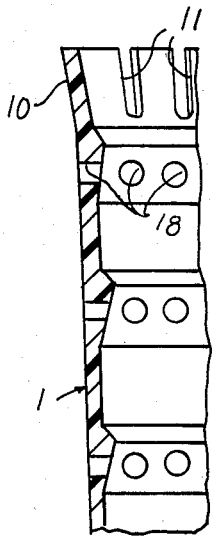
FIG. 7 is an enlarged fragmentary sectional view of a portion of the upper end of the reinforcing member.
Figure 6:
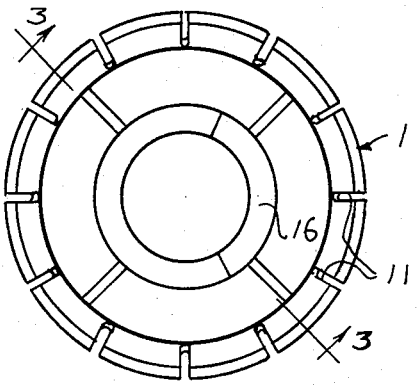
FIG. 6 is an end view of the reinforcing member, looking in the direction of the arrow "6" in FIG. 2.
Figure 4:
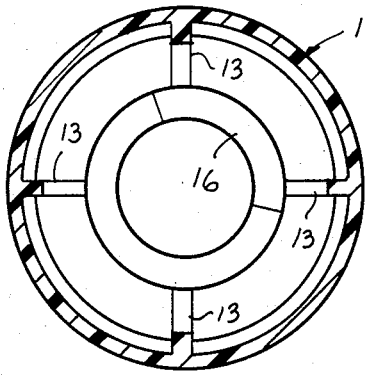
FIG. 4 is a transverse sectional view of the reinforcing member of FIG. 3, taken along line 4—4 in FIG. 3.

When the tubular member is inserted into a bottle, the lower end portion 3 is engaged against the bottom of the bottle and rotated to bring the notches 4 and 5 into registry with the ridge in the bottom of the bottle and "lock" the tubular member in place. At the same time, the notched upper end 10 is compressed as it passes through the neck opening of the bottle and then flares or springs outwardly to latch behind the rim 19 (see FIG. 10) on the neck of the bottle to prevent displacement of the tubular member out of the bottle.

The tubular reinforcing member may be made of any suitable material, such as plastic or the like. It imparts significant strength to the bottle in an axial direction, permitting stacking of bottles without requiring heavy and expensive secondary packaging, while at the same time improving the pouring characteristics of the bottle.

I claim:

1. A container having improved axial strength and controlled pouring, comprising:

a lightweight, thin-walled container having a bottom and a neck with an opening therethrough; and an elongate, rigid, hollow tubular member extending axially in the container from a top end at the neck to a bottom end at the container bottom, said member top and bottom ends engaging the neck and bottom of the container and having means thereon to prevent relative axial and lateral displacement between the member and container, said member being of sufficient rigidity to reinforce the container in an axial direction whereby a number of said containers may be stacked one on top of the other without collapsing the containers, and said member having openings in the side thereof through which material flows when filling the container and when pouring from the container.

2. A container as in claim 1, wherein: said container comprises a bottle.

3. A container as in claim 2, wherein:

said bottle comprises a molded plastic bottle of the type for holding liquid.

4. A container as in claim 3, wherein:

said tubular member comprises a molded plastic member, and said top and bottom ends of the member and the neck and bottom of the bottle have complementally shaped structure thereon to positively locate and retain the ends of the member at the complementally shaped structures on the neck and bottom of the bottle.

5. A container having improved axial strength and controlled pouring, comprising;

a lightweight, thin-walled container having a bottom and a neck with an opening therethrough;

an elongate, rigid, hollow tubular member extending axially in the container from a top end at the neck to a bottom end at the container bottom, said member engaging the container neck and bottom and being of sufficient rigidity to reinforce the container in an axial direction whereby a number of said containers may be stacked one on top of the other without collapsing the containers; and said member having a plurality of openings in the side thereof through which material flows when filling the container and when pouring from the container, the openings in the side of the member being larger toward the bottom end of the member to facilitate filling of material therethrough into the container and being smaller toward the top end of the member to control flow during pouring of material from the container.

6. A container having improved axial strength and controlled pouring, comprising:

a lightweight, thin-walled container having a bottom and a neck with an opening therethrough;

an elongate, rigid, hollow tubular member extending axially in the container from a top end at the neck to a bottom end at the container bottom, said member top and bottom ends engaging the neck and bottom of the container and having sufficient rigidity to reinforce the container in an axial direction whereby a number of the containers may be stacked on top of one another without collapsing the containers;

said member having a plurality of openings through the side thereof through which material flows when filling the container and when pouring from the container; and the top end of the member being resiliently yieldable in a radial direction to enable insertion of the member through the opening in the neck, whereupon said end flexes outwardly to engage said neck and prevent relative axial and lateral movement between said member and container.

7. A container as in claim 6, wherein:

the bottom of the container has a shaped structure formed therein, and the bottom end of the member is complementally shaped to engage said structure and prevent relative axial and lateral displacement therebetween.

8. A container as in claim 7, wherein:

the opposite end portions of the member are frustoconically shaped, being joined at their smaller diameter ends at the middle of the member and tapering outwardly therefrom to the ends thereof.

9. A container as in claim 8, wherein:

there are longitudinally extending reinforcing ribs on the member to prevent bending thereof.

10. A container as in claim 7, wherein:

a shaped keying flange is formed inside said member between the ends thereof for cooperation with an inserting tool which inserts said member axially into said container and rotates the member to cause said complementally shaped structure to come into registry with one another.

* * * * *